US008152168B2

(12) United States Patent
Rossfeldt

(10) Patent No.: US 8,152,168 B2
(45) Date of Patent: Apr. 10, 2012

(54) APPARATUS AND METHOD FOR FORMING A STREAM OF OVERLAPPING SHEETS OR STACKS OF SHEETS

(75) Inventor: Niko Rossfeldt, Hamburg (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 12/625,684

(22) Filed: Nov. 25, 2009

(65) Prior Publication Data

US 2010/0133742 A1 Jun. 3, 2010

(30) Foreign Application Priority Data

Dec. 3, 2008 (DE) ..... 10 2008 060 394

(51) Int. Cl.
*B65H 5/34* (2006.01)
*B65H 29/68* (2006.01)
*B65H 29/32* (2006.01)

(52) U.S. Cl. ..... 271/270; 271/183; 271/197

(58) Field of Classification Search ..... 271/183, 271/197, 270, 182, 196; 198/689.1, 419.2
See application file for complete search history.

(56) References Cited

U.S. PATENT DOCUMENTS

| | | | | |
|---|---|---|---|---|
| 3,178,174 | A * | 4/1965 | Schneider | 271/183 |
| 3,336,028 | A * | 8/1967 | Schonmeier | 271/197 |
| 4,019,731 | A * | 4/1977 | Vits | 271/183 |
| 5,740,661 | A * | 4/1998 | Yamaguchi et al. | 53/553 |
| 6,494,452 | B1 * | 12/2002 | Karasiewicz | 271/276 |
| 6,945,529 | B2 | 9/2005 | Hagemann et al. | |
| 7,059,598 | B2 | 6/2006 | Hagemann et al. | |
| 7,168,699 | B2 | 1/2007 | Schafer et al. | |
| 7,497,318 | B2 * | 3/2009 | Lin | 198/418.9 |
| 2002/0190461 | A1 * | 12/2002 | Hagemann et al. | 271/270 |
| 2004/0124579 | A1 | 7/2004 | Schafer et al. | |
| 2005/0029733 | A1 * | 2/2005 | Hagemann et al. | 271/270 |
| 2007/0096382 | A1 * | 5/2007 | Komori | 271/9.09 |

FOREIGN PATENT DOCUMENTS

| | | |
|---|---|---|
| DE | 30 10 284 A1 | 9/1981 |
| DE | 10128653 | 12/2002 |
| DE | 10353635 | 7/2004 |

OTHER PUBLICATIONS

German Office Action dated Sep. 2, 2009 that issued with respect to patent family member German Patent Application No. 10-2008-060394.5.

* cited by examiner

*Primary Examiner* — Kaitlin Joerger
*Assistant Examiner* — Patrick Cicchino
(74) *Attorney, Agent, or Firm* — Greenblum & Bernstein, P.L.C.

(57) ABSTRACT

An apparatus for forming a stream of overlapping sheets or stacks of sheets, includes a first transport device to deliver overlap-free sheets or stacks of sheets at a speed $v_1$ along a plane of transport $E_V$. A second transport device carries away the sheets or stacks of sheets at a speed $v_2$ along a plane of transport $E_H$. A decelerating device is arranged to receive the sheets or stacks of sheets at the speed $v_1$ from the first transport device, decelerate the sheets or stacks of sheets to the speed $v_2$ and deliver the decelerated sheets or stacks of sheets to the second transport device to form the stream of overlapping sheets or stacks of sheets. The decelerating device comprises a suction roller unit actuated independently of the transport devices. The suction roller unit comprises a stationary element and an unevenly driven movable element.

13 Claims, 5 Drawing Sheets

APPARATUS AND METHOD FOR FORMING A STREAM OF OVERLAPPING SHEETS OR STACKS OF SHEETS

CROSS REFERENCE TO RELATED APPLICATIONS

This application claims priority from German Application No. 10 2008 060 394.5, filed on Dec. 3, 2008, the disclosure of which is incorporated herein by reference in its entirety.

BACKGROUND OF THE INVENTION

The invention concerns an apparatus for forming a stream of overlapping sheets or stacks of sheets, comprising a first transport device for delivering overlap-free sheets or stacks of sheets at a speed $v_1$, a second transport device for carrying away the stream of overlapping sheets or stacks of sheets at a speed $v_2$, and a device for decelerating the sheets or stacks of sheets from $v_1$ to $v_2$. Furthermore, the invention concerns a method for forming a stream of overlapping sheets or stacks of sheets, comprising the steps of: delivering overlap-free sheets or stacks of sheets on a first transport device at a speed of transport $v_1$, decelerating the incoming sheets or stacks of sheets by means of a device for decelerating from the speed of transport $v_1$ to a speed of transport $v_2$ of the outgoing sheets or stacks of sheets, forwarding the sheets or stacks of sheets to a second transport device, and carrying away the stream formed from overlapping sheets or stacks of sheets on the second transport device at the speed of transport $v_2$.

In the paper-processing industry, it is normal to separate individual sheets e.g. from paper webs (or cardboard webs) by at least one of longitudinal or transverse cutting, then assembling them as individual sheets or stacks of sheets into an imbricated or overlapping stream. In order to form the stream from overlapping sheets or stacks of sheets, the individual sheets or stacks of sheets are decelerated from a first (input) speed $v_1$ to a second (output) speed $v_2$. For this purpose, a corresponding device for decelerating the sheets or stacks of sheets is provided between two transport devices. The sheet or stack of sheets, which is located in the region of the decelerating device, is decelerated in the process, while a subsequent sheet or stack of sheets is still being conveyed at the input speed $v_1$. As a result the leading edge of the subsequent sheet/stack of sheets slides over the trailing edge of the sheet/stack of sheets which is just decelerating and leads to overlapping. Naturally, the sheets or stacks of sheets subjected to a stacking or overlapping process can be films or other sheet-like products.

Various apparatuses and methods for forming a stream of overlapping sheets or stacks of sheets are known. In U.S. Pat. No. 3,336,028, for example, an apparatus is disclosed comprising a first transport device including an upper belt and a lower belt for delivering separated sheets or stacks of sheets. The second transport device for carrying them away includes a lower belt, the upper belt of the first transport device extending into the region of the second transport device. To form the device for decelerating the sheets or stacks of sheets, the lower belt of the second transport device is wrapped around a drum unit. The perforated lower belt of the transport device wraps around a drum which has openings and is connected to a vacuum unit for forming a suction drum. Inside the drum is arranged a pipe which has two diametrically opposed openings. Like the drum, the pipe is designed to be movable. Inside the pipe is arranged a stationary pipe which has a slot. The slot is directed onto the region of transfer of the sheets or stacks of sheets from the first transport device, and is opened or closed by at least one of the pipe or drum in phases/alternately.

German Patent Document DE 30 10 284 A1 is also concerned with an apparatus for conveying and overlapping sheets or sheet stacks. This apparatus comprises an upper belt extending over the whole length and two lower belts of which one lower belt is designed and arranged as a transport device for delivering sheets or stacks of sheets, and the other lower belt is designed and arranged for carrying away the overlapping sheets or stacks of sheets. Between the lower belts are arranged guide rollers. The rear lower belt is designed as an endless decelerating suction belt and has, between the upper and lower runs, a suction box in which is arranged a rotating suction pipe which is provided with an opening.

The known apparatuses and methods have the drawback that the rotating elements rotate at a constant speed and the circumferential speeds of drum and pipe or suction pipe are merely adapted only to the paper format to be processed. This means that the transport devices on the one hand and the decelerating device on the other hand have different speeds. Hence a relative speed arises between the sheets or stacks of sheets and the decelerating device. As a result, deceleration and the accompanying overlapping of the sheets or stacks of sheets is inadequate and imprecise, particularly at high speeds. It might also be said that energy is destroyed suddenly by the different speeds of the sheets or stacks of sheets on "impact" of the sheets or stacks of sheets on the transport device provided for carrying them away, leading to imprecise transfer. The imprecision of overlap is further reinforced by the fact that, during deceleration, support from above is required, that is, a decelerating action on the sheets or stacks of sheets is required on both sides, and there is only indirect contact between the decelerating device and the sheets or stacks of sheets. A further drawback of known apparatuses is that the apparatuses are structurally elaborate, which among other things, makes it difficult to exchange parts during maintenance or repair.

SUMMARY

It is therefore an object of the invention to provide a simple and reliable apparatus for forming a stream of overlapping sheets or stacks of sheets, by means of which precise overlapping of the sheets or stacks of sheets can be carried out. It is further an object of the invention to provide a corresponding method.

The above and other objects are accomplished according to one aspect of the invention wherein there is provided an apparatus for forming a stream of overlapping sheets or stacks of sheets which, according to one embodiment, comprises a first transport device to deliver overlap-free sheets or stacks of sheets at a speed v1 along a plane of transport EV, a second transport device to carry away the sheets or stacks of sheets at a speed v2 along a plane of transport EH, and a decelerating device arranged to receive the sheets or stacks of sheets at the speed v1 from the first transport device, decelerate the sheets or stacks of sheets to the speed v2 and deliver the decelerated sheets or stacks of sheets to the second transport device to form the stream of overlapping sheets or stacks of sheets, wherein the decelerating device comprises a suction roller unit is actuated independently of the transport devices, and wherein the suction roller unit comprises a stationary element and an unevenly driven movable element.

The uneven driving of the movable element means that the movable element can be decelerated and accelerated, that is, operated at different speeds during the deceleration process, so that the sheets or stacks of sheets may be taken over and discharged without slipping and without relative movement in relation to the decelerating device. This guarantees precise overlapping of the sheets or stacks of sheets. Separation of the components of transport devices on the one hand and decelerating device on the other hand makes it easier to transfer the sheets or stacks of sheets to form a stream of overlapping sheets or stacks of sheets, and allows easy exchange or easy maintenance of component parts of the apparatus.

In an embodiment of the invention the movable element may be a rotatably drivable cylindrical outer ring in which a stationary vacuum unit is arranged as the stationary element. With this design, precise pick-up, deceleration and discharge of the sheets or stacks of sheets into a stream of overlapping sheets or stacks of sheets is further improved by the fact that the speed of rotation of the rotating element is controllable with particular precision.

In a further embodiment of the invention, the outer ring and the vacuum unit may be constructed and designed to correspond to each other to form at least one optionally closable or openable suction opening. In other words, both the outer ring and the vacuum unit may have at least one opening which can either be brought into register by the relative movement between outer ring and vacuum unit to form the suction opening for drawing in the sheets or stacks of sheets, or close the suction opening when the openings are staggered. Thus reliable suction of the sheets or stacks of sheets can be carried out very precisely and rapidly.

In another embodiment, the movable element of the suction roller unit may be in direct contact with the sheets or stacks of sheets during deceleration, with the result that handling of the sheets or stacks of sheets and the precision of placement or take-over and discharge of the sheets or stacks of sheets are improved.

According to a further embodiment of the invention, the suction roller unit may be constructed and designed for application of the decelerating force to the sheets or stacks of sheets on one side only. In other words, the suction roller unit may engage the sheets or stacks of sheets only from below, dispensing with additional mechanical or otherwise operating elements from above, so that e.g. at least one of coated sheets, printed sheets, or stacks of sheets can be transported and formed into a stream of overlapping sheets or stacks of sheets.

Additionally, in another embodiment the speed of rotation of the movable element of the suction roller unit may be controlled individually. This means that the speed of rotation may be varied at least one of during a single revolution, from one sheet to the next, or from one stack of sheets to the next, which allows easy and rapid adaptation of the apparatus e.g. when changing format, that is, when changing the sheet size.

According to another aspect of the invention, there is provided a method for forming a stream of overlapping sheets or stacks of sheets, comprising, according to an embodiment, comprising delivering overlap-free sheets or stacks of sheets on a first transport device at a speed of transport v1 in a first plane of transport EV, driving a suction roller unit initially at the speed of rotation v1, collecting the sheets or stacks of sheets at speed v1 from the first transport unit by fixing the sheets or stack of sheets to the suction roller unit while rotating at the initial speed of rotation v1, decelerating the suction roller unit to speed a speed v2 after collecting the sheets or stacks of sheets, discharging decelerated sheets or stacks of sheets to a second transport device at the speed v2 and in a second plane of transport EH, accelerating the suction roller unit back to speed v1 after discharge of the sheets or stacks of sheets, collecting subsequent sheets or stacks of sheets after acceleration of the suction roller unit back to speed v1 and discharging the subsequent sheets at the speed v2 to the second transport device to form the stream of overlapping sheets or stacks of sheets, and carrying away the stream of overlapping sheets or stacks of sheets on the second transport device at the speed of transport v2.

BRIEF DESCRIPTION OF THE DRAWINGS

The present invention will be more readily understood from the following detailed description when read in conjunction with the accompanying drawings, in which:

FIG. 4 is a top view of the apparatus according to

FIG. 3 without the upper belt according to an embodiment of the invention.

Figure 1:
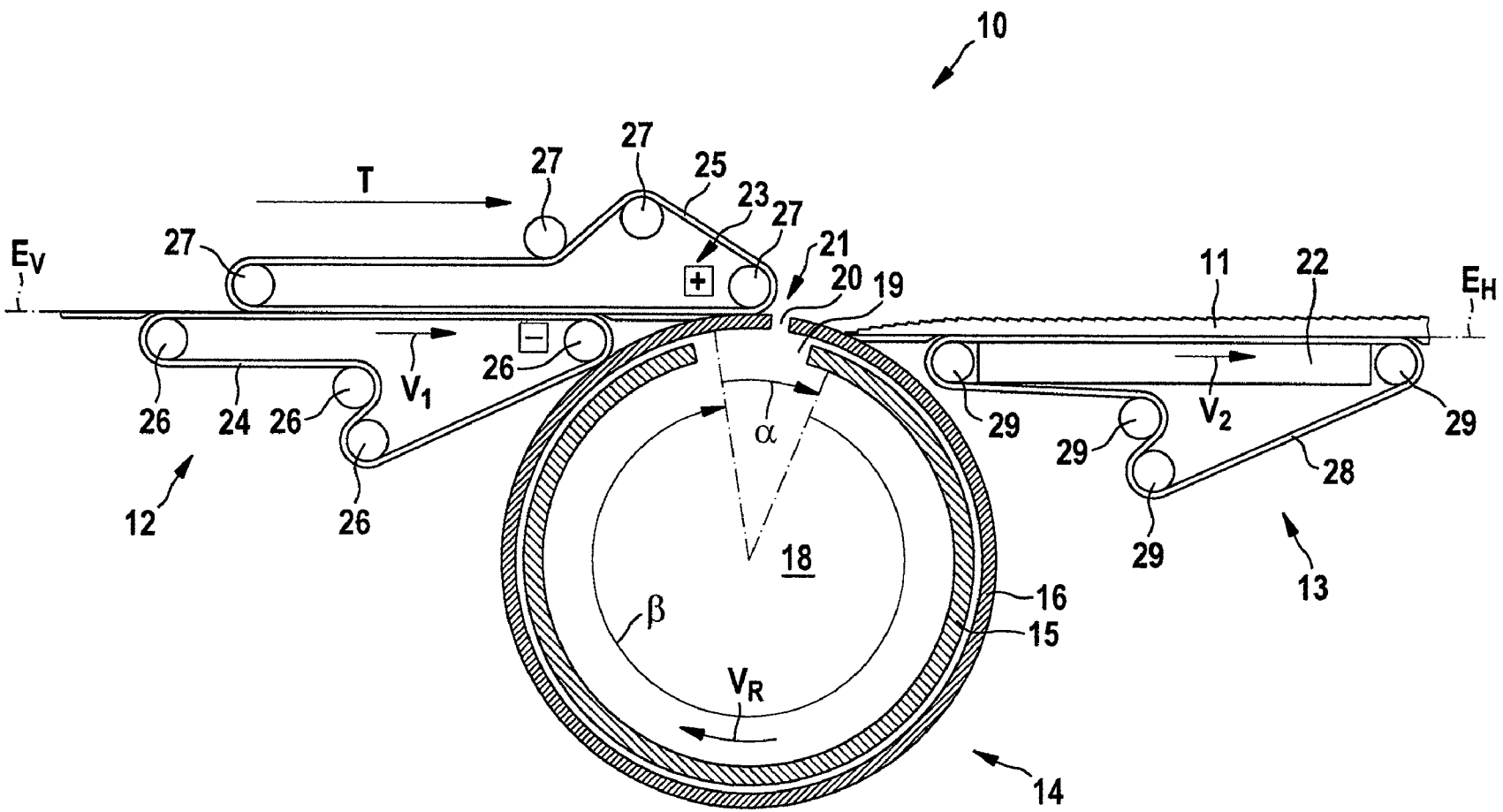
FIG. 1 is a schematic side view, in partial section, of a first embodiment of the apparatus according to an embodiment of the invention.

The apparatuses shown in the drawings and described in more detail below serve to form an imbricated stream of sheets or stacks of sheets of paper or cardboard. Naturally, the apparatuses are also suitable for forming an imbricated stream of sheets or stacks of sheets of film or the like as well as for stacking.

DETAILED DESCRIPTION

A first embodiment of the apparatus 10 according to the invention is shown in FIG. 1. The apparatus 10 for forming a stream 11 of overlapping sheets or stacks of sheets comprises a first, upstream transport device 12 for delivering overlap-free sheets or stacks of sheets at speed $v_1$, and a second, downstream transport device 13 for carrying away the stream 11 at speed $v_2$. The speeds $v_1$ and $v_2$ differ from each other. To form an imbricated stream 11 of sheets or stacks of sheets, $v_2$ is lower than $v_1$. Furthermore, the apparatus 10 comprises a device 14 for decelerating the sheets or stacks of sheets from $v_1$ to $v_2$. The device 14 is a kind of link between the transport devices 12, 13 and lies approximately in at least one of the plane $E_V$ of the incoming sheets or stacks of sheets or in the plane $E_H$ of the outgoing stream 11 (see below).

Figure 4:
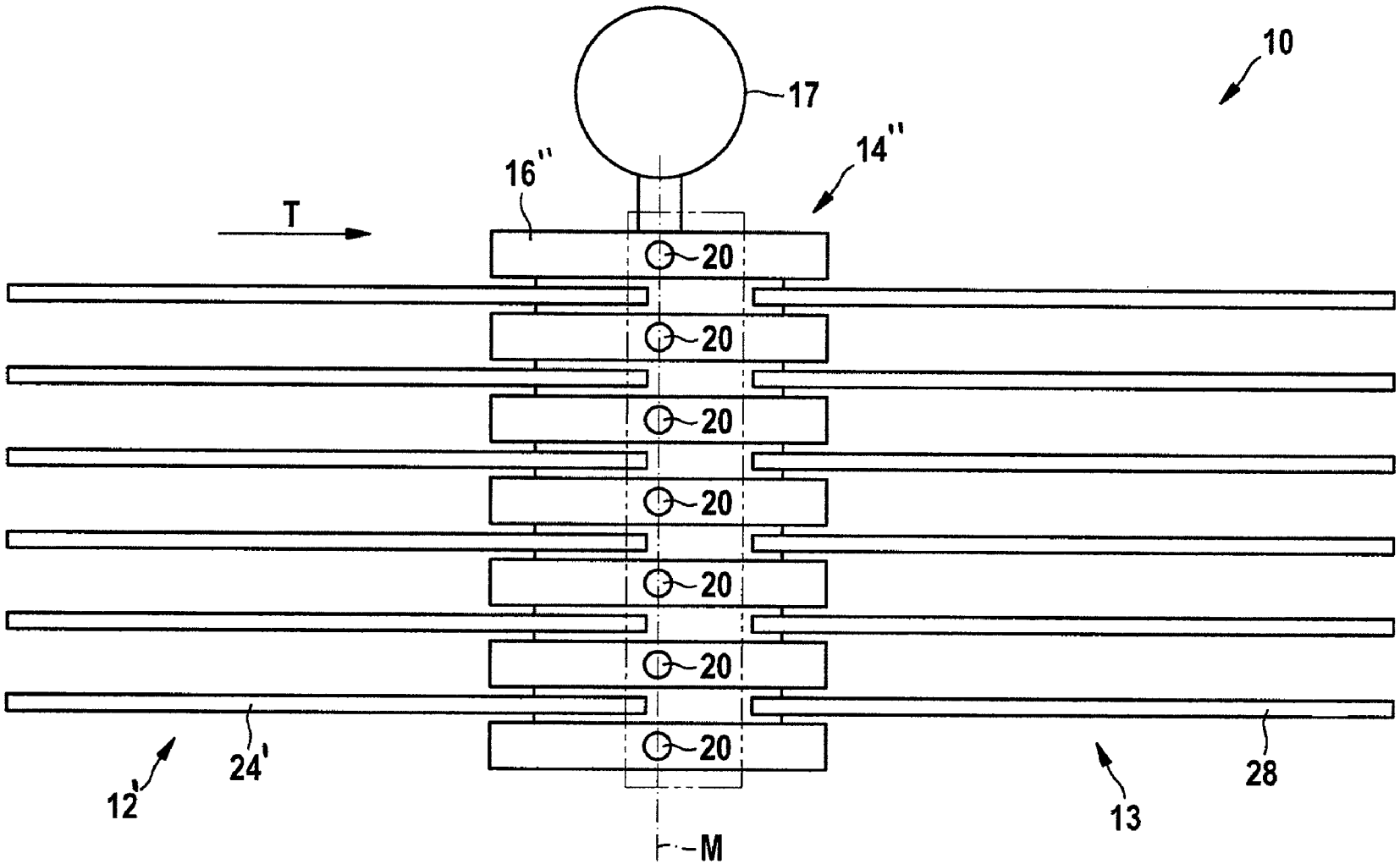

The device 14 for decelerating the sheets or stacks of sheets is designed as a suction roller unit and is independent of the transport devices 12, 13. This means that the device 14 is a separate unit which is operatively connected to the transport devices 12, 13, but can be actuated independently of them. The device 14 comprises a stationary element 15 and a movable element 16. The movable element 16 is assigned a drive 17 (see FIG. 4) for rotary driving. But the movable element 16 can also be assigned a further drive, so that the movable element 16 is driven from both sides. Each drive 17 is constructed and designed for uneven driving of the movable element 16. This means that the speed of rotation $v_R$ of the movable element 16 is variable, so that the speed of rotation $v_R$ itself is variable during a single revolution. By means of the uneven driving, with respect to the speed of rotation $v_R$, angles of deceleration $\alpha$ and angles of acceleration $\beta$ can be described, of which the quantities are however variable. During deceleration the movable element 16 of the suction roller unit is in direct contact with the sheets or stacks of sheets. In other words, the suction roller unit becomes directly operatively connected to the sheets or stacks of sheets without a conveyor belt.

In an embodiment of the invention as in FIG. 1, the rotatably driveable, movable element 16 is a cylindrical outer ring. The outer ring can be formed in one piece or from several connected or separate segments. The stationary element 15 is a vacuum unit which is arranged inside the tubular outer ring. The vacuum unit can also be ring-shaped and forms a vacuum chamber 18. The vacuum unit has in its circumferential surface at least one opening 19, but may have several openings. Each opening 19 is directed upwards in the direction of the sheets or stacks of sheets on the stationary vacuum unit. A single opening 19 can be provided across the width of transport of the sheets or stacks of sheets. It is also possible for more than one row of openings 19, for example two or more rows, to be arranged or designed adjacent to each other in the circumferential direction. The openings 19 can be bores, oblong holes or the like. The outer ring is rotatable about the vacuum unit and also has at least one opening 20. One opening 20 or several openings 20 (see e.g. FIG. 4) extend partly or completely across the width of transport of the sheets or stacks of sheets. For this purpose bores, oblong holes or the like are formed e.g. in a thin-walled tube forming the outer ring. The opening 20 can also be a through-slot running parallel to the centre axis M. It is also possible for several openings 20' or rows of openings 20' to be arranged diametrically opposite (see e.g. FIG. 3) or offset from each other at a different angle. The size of the opening 19 or openings 19 in the stationary element 15 in the circumferential direction ultimately defines the quantity of the angle of deceleration $\alpha$. The larger each opening 19 in the circumferential direction, the greater the angle of deceleration $\alpha$ and vice versa. Each opening 20 in the movable element 16 is much smaller than the opening 19, with respect to the circumferential direction. The openings 19 and 20 are coordinated with each other so the two openings 19, 20, when they are in register with each other, open a suction opening 21 which varies in position dependent on the movement of the movable element 16. In the event that the outer ring with its opening 20 or openings 20 is rotated relative to the vacuum unit with its opening or openings 19, so that the openings 19, 20 are no longer in register, the suction opening 21 is closed.

The two transport devices 12, 13 are arranged one behind the other in the direction of transport T of the sheets or stacks of sheets. The two transport devices 12, 13 have a gap between them in the (working) region of which the device 14 is arranged. The transport device 13 which is downstream in the direction of transport T may offset downwards from the upstream transport device 12, so that the sheets or stacks of sheets pass in stages, as it were, from the upstream transport device 12 via the device 14 to the downstream transport device 13. As can be seen e.g. from FIG. 1, the sheets or stacks of sheets lie in one plane $E_V$ on the upstream transport device 12, while the stream 11 of overlapping sheets or stacks of sheets lies in a plane $E_H$ which is arranged beneath the plane $E_V$. The device 14 or the shell of the outer ring of the suction roller unit may be tangent to plane $E_V$, but can also be located beneath plane $E_V$ or pass through plane $E_V$ from below. In further embodiments the downstream transport device 13 can lie in the same plane as the upstream transport device 12, in which case at least the input region of the downstream transport device 13 is directed obliquely downwards out of the plane of transport $E_H$ which in this case corresponds to plane $E_V$.

As can be seen from the figures in all the embodiments, the device 14, namely the suction roller unit, is constructed and designed for applying the deceleration force to the sheets or stacks of sheets on one side only. In other words, the device 14 acts exclusively from below, so that the sheets or stacks of sheets are drawn in from below and decelerated by reduction of the speed of rotation $v_R$ of the suction roller unit or, to be more precise, of the movable element 16. The speed of rotation $v_R$ of the movable element 16 (in this embodiment the outer ring) can be controlled individually. For this purpose each drive 17 is connected to a control means by means of which the speed of rotation $v_R$ is adjustable in particular in dependence of the speeds of transport $v_1$ and $v_2$, the number and positioning of the openings 19, 20 or suction opening 21, and the format of the sheets.

Optionally the second transport device 13 which is downstream in the direction of transport T can be assigned an additional suction unit 22. This suction unit 22 is arranged so the stream 11 of overlapping sheets or stacks of sheets is fixed or guided reliably. In other words, the suction unit 22 prevents the slipping of sheets or stacks of sheets on the transport device 13. In the region of the first transport device 12, which is upstream in the direction of transport T, can be arranged an electrostatically operating element 23 for interlocking incoming stacks of sheets. An ionisation device of this kind serves to interlock several sheets forming a stack of sheets for transport within the apparatus 10 and deceleration to form the stream 11 of overlapping stacks of sheets. The element can be constructed in one or more parts and at least one of arranged above or below the transport device 12.

The first transport device 12 which is upstream in the direction of transport T comprises a lower belt 24 and an upper belt 25. Both belts are endlessly rotating belts, chains or the like and are guided about at least one of driving or deflecting rollers 26 or 27. The second transport device 13 which is downstream in the direction of transport T has only a lower belt 28 which, like the belts of the transport device 12, can be an endlessly rotating belt, a chain or the like and is guided about at least one of driving or deflecting rollers 29. The lower belts 24 and 28 and the upper belt 25 can also be formed from several belt strips which are spaced apart from each other. The upper belt 25 of the transport device 12 can vary in particular in length and positioning. This means that the upper belt 25 may protrude slightly beyond the lower belt 24 e.g. in the direction of transport T according to FIG. 1, to a point over the region of the opening 19 in the stationary element 15, the opening 19 being only partly covered, only in a very small region. A further embodiment as in FIG. 3, on the other hand, shows that a deflecting roller 25' can be arranged so the upper belt 25' of the transport device 12 can also extend into the region of the lower belt 28 of the transport device 13 and even overlap it. The lower belt 24 of the transport device 12 in the embodiments according to FIGS. 1 and 2 ends before the device 14 and, to be more precise, before the outer ring. This means that the lower belt 24 does not mesh with the device 14. The design and arrangement in the apparatus 10 according to FIG. 3 are different. With this apparatus 10, a deflecting roller 26' of the transport device 12' is arranged so the lower belt 24' meshes with the device 14", as can also be seen from FIG. 4. The lower belt 24' is split in the embodiment according to FIG. 3. In other words, the lower belt 24' is formed from several belt strips, so that the lower belt 24' or the belt strips mesh with the suction roller unit and, to be more precise, with the stationary element 15" and the movable element 16". This can be seen in particular in FIG. 4. By contrast the lower belt 24' is, like the upper belt 25 in the embodiment of FIGS. 1 and 2, designed as belt strips and consists of parallel, spaced-apart belt strips.

Figure 2:
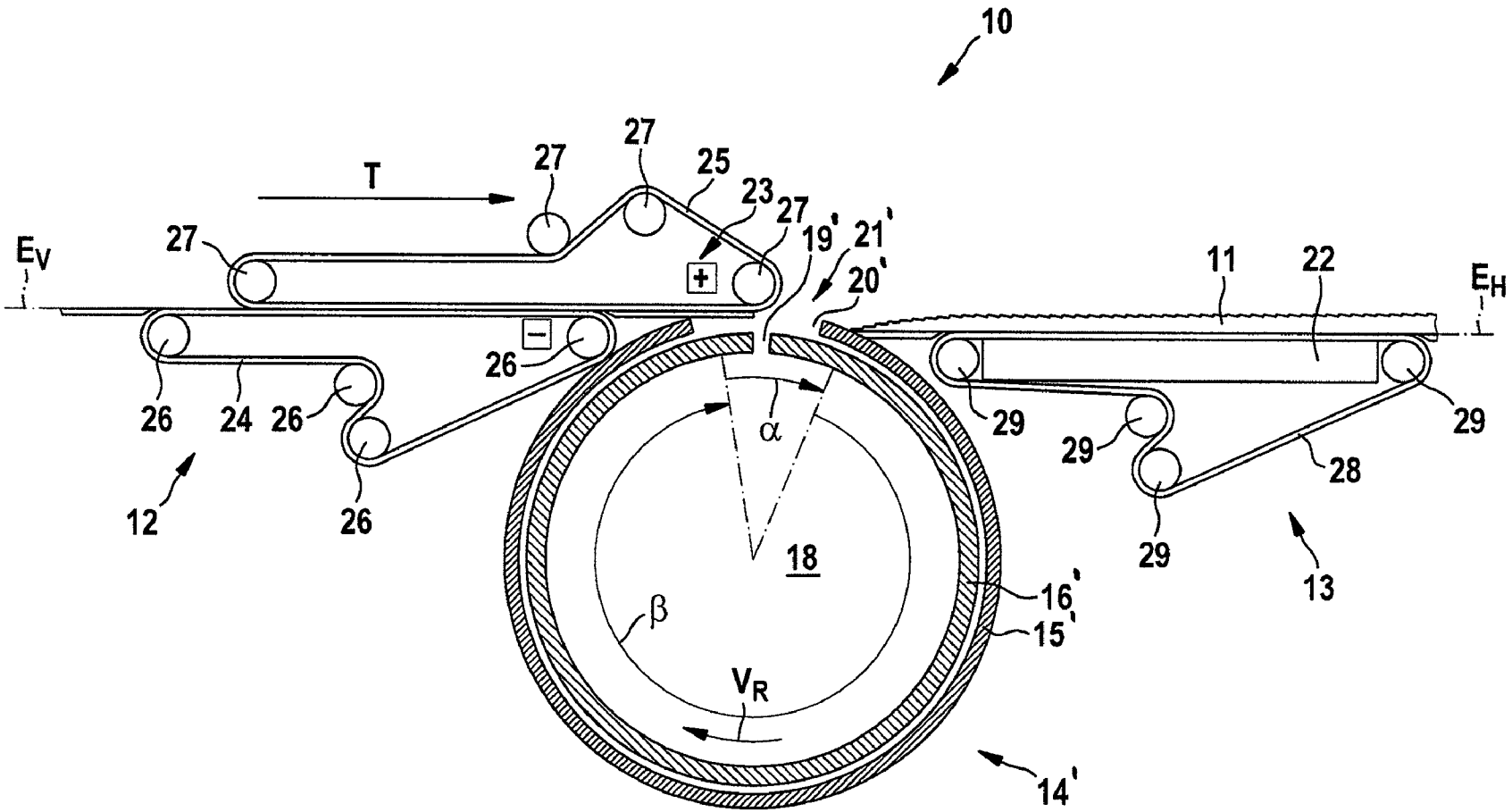
FIG. 2 is a schematic side view, in partial section, of a further embodiment of the apparatus according to an embodiment of the invention.
Figure 3:
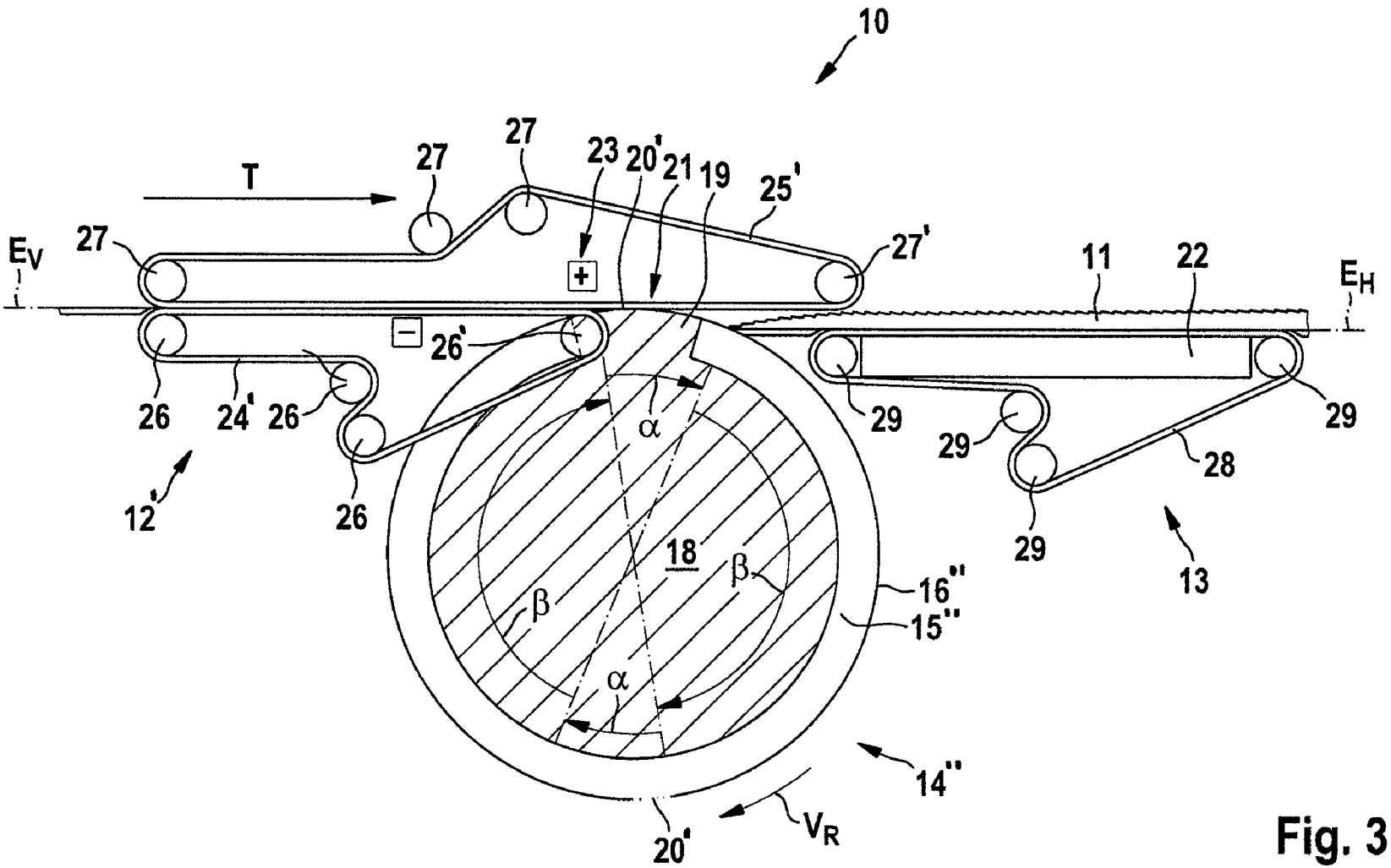
FIG. 3 is a schematic side view, in a partial section, of a further embodiment of the apparatus according to an embodiment of the invention.

The apparatus 10 in the second embodiment according to FIG. 2 essentially corresponds to the apparatus 10 as in FIG. 1. However, the stationary element 15' of the device 14' in the embodiment according to FIG. 2 is the outer ring, and the rotatably driveable, movable element 16' is the vacuum unit which is arranged inside the outer ring. For the suction opening 21', the opening 20', which in this case defines the quantity of the angle of deceleration α, is accordingly larger in the circumferential direction than the opening 19' in the movable element 16'.

Below, the principle of the method is described in more detail with the aid of the attached figures.

Individual sheets or stacks of sheets, e.g. of at least one of transversely or longitudinally cut paper or cardboard, are conveyed on the transport device 12 in the direction of transport T, this being at speed $v_1$. The sheets or stacks of sheets, which lie without overlap on the transport device 12, enter the region of the decelerating device 14 and are decelerated by the device 14 from the speed of transport $v_1$ to a speed of transport $v_2$. Deceleration takes place with the apparatus 10 according to FIG. 1 as follows. The vacuum unit as the stationary element 15 is directed with its opening 19 upwards in the direction of the sheets or stacks of sheets. The opening 19 is closed by the movable element 16, in this case the outer ring, until the trailing edge of the incoming sheet or stack of sheets reaches the device 14 and, to be more precise, the shell of the suction roller unit and, to be more precise, of the outer ring. The outer ring is controlled in its speed of rotation $v_R$ so the moment the trailing end of the sheets or stacks of sheets reach the outer ring, the opening 20 in the outer ring is in register with the opening 19 in the vacuum unit. The speed of rotation $v_R$ of the outer ring corresponds in that moment to the assumption of speed of transport $v_1$. As soon as the sheets or stacks of sheets have been taken over or collected by suction, the speed of rotation $v_R$ of the outer ring is reduced, the deceleration force acting as long as there is an overlap between the openings 19 and 20. This means that the sheets or stacks of sheets are reduced at the angle of deceleration α from $v_1$ to $v_2$, that is, to the speed of transport of the downstream transport device 13.

The sheets or stacks of sheets are still held by the suction roller unit at their downstream, trailing end, while the leading end is already on the transport device 13. During deceleration, the subsequent sheet or stack of sheets which is still being conveyed at speed $v_1$ is slid over the decelerating sheet or stack of sheets. As soon as the opening 20 in the outer ring no longer corresponds to the opening 19 in the vacuum unit, that is, is no longer in register, the suction process ends because the suction opening 21 is closed, and the sheets or stacks of sheets are carried away by the transport device 13 at speed of transport $v_2$. Immediately after closure of the suction opening 21, by further rotation of the outer ring the latter is accelerated in order to collect the next sheet or stack of sheets. In the process the outer ring is accelerated at the angle of acceleration β back to the speed of transport $v_1$ until $v_R$ corresponds to $v_1$, so that the subsequent sheet or stack of sheets is caught in the same position as the preceding sheet or stack of sheets.

On collection and during deceleration of the sheets or stacks of sheets, the sheets or stacks of sheets abut directly against the suction roller unit and, to be more precise, in particular also against the outer ring. In this case, the deceleration force acts exclusively from below. In other words, the sheets or stacks of sheets are drawn in exclusively from one side, namely from below, during collection and deceleration. In the embodiment according to FIG. 1, during a single revolution the suction roller unit describes an angle of deceleration α and an angle of acceleration β. Other possibilities are apparent e.g. from FIG. 3 in which two angles of deceleration α and two angles of acceleration β are provided. The sheets or stacks of sheets may be decelerated in the same plane as they are delivered. This means that the sheets or stacks of sheets are first taken over by plane $E_V$ and held in this plane and decelerated before they are discharged to plane $E_H$ which is located slightly below plane $E_V$. The stream 11 of overlapping sheets or stacks of sheets, which lies in plane $E_H$ on the transport device 13, is drawn in by the suction unit 22 while they are carried away. In the event that stacks of sheets are delivered on the transport device 12, the stacks of sheets are ionised before reaching the device 14. Thus the individual sheets of a stack are locked together. This means that the sheets of a stack are prevented from slipping or the like relative to each other by an electrostatic charge.

The apparatus according to FIG. 2 works basically according to the principle just described. However, the outer ring with the opening 20' is stationary, while on the inside the vacuum unit with the opening 19' rotates.

Figure 5:
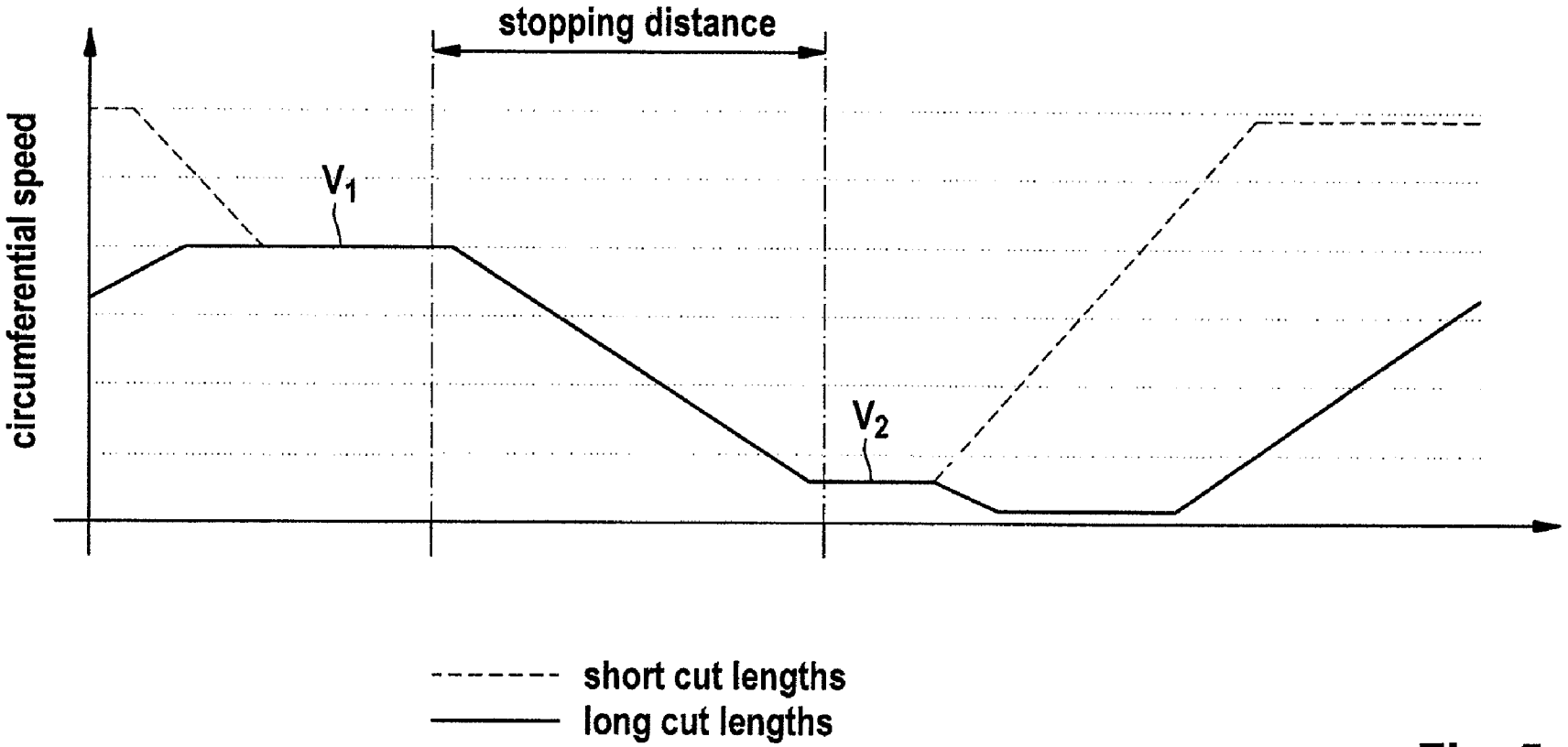
FIG. 5 is a graph of the acceleration and deceleration behaviour for different cut lengths according to an embodiment of the invention.

Other procedures are possible, for example when the movable element 16 has several openings 20 (see FIG. 3). Then the outer ring is decelerated several times, for example twice, and accelerated again during one revolution. The uneven driving, that is, deceleration and acceleration of the movable element 16 in particular also depends on the cut length, that is, the length of the sheets. In the case of short cut lengths (broken line in FIG. 5), that is, e.g. short sheets, the subsequent sheet which comes from the delivery transport device 12 is collected so that it is caught in the same position as the preceding sheet. This means that the movable element 16 is accelerated more in order to collect, as it were, the next incoming sheet. Conversely, the movable element 16 is accelerated more slowly or even waits if the cut length is long (unbroken line in FIG. 5). It might also be said that the suction hole 21 waits for the sheet. Here, waiting or collection is controlled by the driving speed or speed of rotation $v_R$ of the movable element 16.

It will be understood that the above description of the present invention is susceptible to various modifications, changes and adaptations, and the same are intended to be comprehended within the meaning and rage of equivalents of the appended claims.

The invention claimed is:

1. An apparatus for forming a stream of overlapping sheets or stacks of sheets, comprising:

a first transport device to deliver overlap-free sheets or stacks of sheets at a speed $v_1$ along a plane of transport $E_V$;

a second transport device to carry away the sheets or stacks of sheets at a speed $v_2$ along a plane of transport $E_H$; and a decelerating device arranged to receive the sheets or stacks of sheets at the speed $v_1$ from the first transport device, decelerate the sheets or stacks of sheets to the speed $v_2$ and deliver the decelerated sheets or stacks of sheets to the second transport device to form the stream of overlapping sheets or stacks of sheets, wherein the decelerating device comprises a suction roller unit that is actuated independently of the transport devices, wherein the suction roller unit comprises a stationary element and an unevenly driven movable element, and wherein a speed of rotation of the movable element of the suction roller unit is controlled independently of the first and second transport devices.

2. The apparatus according to claim 1, wherein the movable element comprises a rotatably driveable cylindrical outer ring and the stationary element comprises a stationary vacuum unit arranged in the movable element.

3. The apparatus according to claim 2, wherein the outer ring and the vacuum unit are arranged to correspond to each other to form at least one selectively closable or openable suction opening.

4. The apparatus according to claim 1, wherein the movable element of the suction roller unit is arranged to be in direct contact with the sheets or stacks of sheets during deceleration.

5. The apparatus according to claim 1, wherein the second transport device is downstream of the first transport device in a direction of transport T of the stream and is spaced apart and offset downwardly from the first transport device.

6. The apparatus according to claim 1, wherein the suction roller unit is one of circumferentially tangent to at least one of the planes of transport $E_V$ and $E_H$ defined by the transport devices or at least partially passes through at least one of the planes.

7. The apparatus according to claim 1, wherein the suction roller unit is arranged to apply a decelerating force to the sheets or stacks of sheets on only one side of the sheets or stacks of sheets.

8. The apparatus according to claim 1, wherein the second transport device is downstream of the first transport device in a direction of transport T of the stream and includes an additional suction unit for fixing the stream.

9. The apparatus according to claim 1, and further comprising an electrostatically operating element arranged in a region of the first transport device to interlock incoming stacks of sheets, wherein the first transport device is upstream of the second transport device in the direction of transport T of the stream.

10. The apparatus according to claim 1, wherein the first transport device is upstream of the second transport device in a direction of transport T of the stream and comprises an upper belt and a lower belt, wherein the upper belt is one of overlapping the second transport device or ending before the second transport device.

11. The apparatus according to claim 1, wherein the second transport device is downstream of the first transport device in a direction of transport T of the stream and comprises solely a lower belt.

12. The apparatus according to claim 1, wherein the unevenly driven movable element is driven at a variable speed of rotation.

13. The apparatus according to claim 1, wherein the unevenly driven movable element is structured and arranged to provide a variable speed of rotation, such that the variable speed of rotation is varied during a single revolution of the unevenly driven movable element.

* * * * *